US011841688B2

(12) United States Patent
Krüttli et al.

(10) Patent No.: US 11,841,688 B2
(45) Date of Patent: Dec. 12, 2023

(54) DISPLAY DEVICE FOR A TIMEPIECE AND TIMEPIECE COMPRISING SUCH A DEVICE

(71) Applicant: PATEK PHILIPPE SA GENEVE, Geneva (CH)

(72) Inventors: Anthony Krüttli, Orchamps-Vennes (FR); Nicolas Dehon, La Chaux-de-Fonds (CH)

(73) Assignee: PATEK PHILIPPE SA GENEVE, Geneva (CH)

( * ) Notice: Subject to any disclaimer, the term of this patent is extended or adjusted under 35 U.S.C. 154(b) by 370 days.

(21) Appl. No.: 17/271,945

(22) PCT Filed: Aug. 28, 2019

(86) PCT No.: PCT/IB2019/057249
§ 371 (c)(1),
(2) Date: Feb. 26, 2021

(87) PCT Pub. No.: WO2020/044258
PCT Pub. Date: Mar. 5, 2020

(65) Prior Publication Data

US 2021/0325832 A1 Oct. 21, 2021

(30) Foreign Application Priority Data

Aug. 28, 2018 (EP) ..... 18191238

(51) Int. Cl.
*G04F 7/08* (2006.01)

(52) U.S. Cl.
CPC ..... *G04F 7/0804* (2013.01); *G04F 7/0857* (2013.01)

(58) Field of Classification Search
CPC .... G04F 7/0804; G04F 7/0857; G04F 7/0852; G04F 7/062; G04F 7/0819
See application file for complete search history.

(56) References Cited

U.S. PATENT DOCUMENTS

2006/0280037 A1 12/2006 Houlon et al.
2016/0299471 A1 10/2016 Nagahama
2017/0185046 A1 6/2017 Graemiger

FOREIGN PATENT DOCUMENTS

CH 706208 9/2013
CN 107045277 A 8/2017
(Continued)

OTHER PUBLICATIONS

Translation of EP-1475682, Apr. 24, 2023, Espacenet.*
(Continued)

*Primary Examiner* — Renee S Luebke
*Assistant Examiner* — Matthew Hwang
(74) *Attorney, Agent, or Firm* — NIXON & VANDERHYE

(57) ABSTRACT

The display device is arranged in a timepiece which includes a counting wheel and a manual control mechanism which is arranged to permit cyclical starting, stopping and resetting of the counting wheel. The display device includes an indicating member, a unit for moving the indicating member into a first predefined position when the counting wheel is being reset, a unit for moving the indicating member into a second predefined position, different from the first predefined position, when the counting wheel is being started, and a unit for permitting the indicating member to be moved into a reading position following stopping of the counting wheel, the reading position being determined by the position of the counting wheel.

19 Claims, 7 Drawing Sheets

(56) References Cited

FOREIGN PATENT DOCUMENTS

| | | | | |
|---|---|---|---|---|
| EP | 1 024 416 | | 8/2000 | |
| EP | 1475682 | A1 * | 11/2004 | ..... G04F 7/0814 |

OTHER PUBLICATIONS

International Search Report for PCT/IB2019/057249 dated Dec. 6, 2019, 5 pages.
Written Opinion of the ISA for PCT/IB2019/057249 dated Dec. 6, 2019, 5 pages.
Office Action issued in Chinese Patent Application No. 201980056664.0 dated Oct. 8, 2021.

* cited by examiner

DISPLAY DEVICE FOR A TIMEPIECE AND TIMEPIECE COMPRISING SUCH A DEVICE

CROSS-REFERENCE TO RELATED APPLICATIONS

This application is the U.S. national phase of International Application No. PCT/IB2019/057249 filed Aug. 28, 2019 which designated the U.S. and claims priority to EP 18191238.7 filed Aug. 28, 2018, the entire contents of each of which are hereby incorporated by reference.

According to a first aspect, the present invention relates to a display device for a timepiece which comprises a counting wheel and a manual control mechanism which is arranged to permit cyclical starting, stopping and resetting of the counting wheel, the display device comprising an indicating member and means permitting the indicating member to be moved into a reading position following stopping of the counting wheel, the reading position being determined by the position of the counting wheel.

According to a second aspect, the present invention relates to a timepiece comprising a display device according to the first aspect of the invention.

PRIOR ART

Timepieces are known which comprise a display device according to the definition given above. Patent document EP 1 024 416 A2 in particular describes a display device intended to be fitted in a chronograph. In a conventional manner, this chronograph also comprises a control device and a chronograph going train. The chronograph going train itself comprises a seconds counting wheel arranged to be driven at the rate of one turn per minute and a fifths-of-a-second counting wheel arranged to be driven at the rate of one turn in ten seconds. In a conventional manner, the chronograph-hand is mounted on the spindle of the seconds counting wheel. For its part, the fifths-of-a-second counting wheel is associated with a retrograde hand provided to indicate the fifths-of-a-second on a graduation arranged along an arc of a circle.

The display device described in the earlier document mentioned above comprises a snail which is mounted on the spindle of the fifths-of-a-second counting wheel so as to turn therewith, a dedicated push button, which can be used only when the chronograph is stopped, and a main lever arm which is fitted with a feeler spindle and a toothed sector. The toothed sector is arranged to be in engagement with a gear-train connected to the retrograde hand so as to permit the main lever arm to control the position of this hand. A return spring is also arranged to exert a force on the main lever arm, this force tending to urge the feeler spindle against the periphery of the snail in order to read the timed fraction of a second. Until the push button is actuated, the main lever arm is blocked in a raised position so that the feeler spindle is kept away from the snail and the retrograde hand is in an inoperative position located above a neutral (out of range) zone of the dial. Actuation of the push button causes the main lever arm to be released so that it pivots and the feeler spindle comes to bear against the periphery of the snail. The pivoting of the lever arm has the effect of moving the retrograde hand above a position of the graduation which corresponds to the fifth of a second to be indicated. When the push button is then released, the main lever arm returns to its raised position and the retrograde hand resumes its inoperative position above the neutral zone of the dial.

A disadvantage of this earlier solution is that the retrograde hand does not return to zero with the other counting hands when the user causes the chronograph to be reset. Many users are in the habit of monitoring the operation of their chronograph by checking with a glance that all the hands have indeed returned to zero after the chronograph has been reset. In this situation, the fact that the retrograde hand is not designed to return to zero can give the user a false impression that the chronograph is not operating in an optimal fashion.

BRIEF DESCRIPTION OF THE INVENTION

One aim of the present invention is to overcome the disadvantages of the prior art which have just been described. The present invention achieves this aim and others by providing a display device according to the accompanying claim 1, and by providing a timepiece according to the accompanying claim 15.

In accordance with the invention, the display device comprises means for moving the indicating member to a first predefined position associated with the "zero" value when the counting wheel is being reset, and for moving the indicating member to a second predefined position, different from the first predefined position, when the counting wheel is started.

One advantage of the features of the invention listed above is that the indicating member moves, passing from one fixed position to another, when the counting wheel is being started. This movement confirms to the user that the counting wheel has actually been started. On the other hand, a user who is familiar with his timepiece knows that, when the indicating member is in the second predefined position, it indicates that the counting wheel is turning. In the case of a prior art timepiece comprising a large chronograph-hand in the centre, the movement of the hand will generally suffice to indicate that the chronograph going train is operating. In contrast, if the prior art timepiece is not fitted with a large chronograph-hand, the user may be unsure that the mechanism is operating. It will be understood that the present invention overcomes this problem in particular.

BRIEF DESCRIPTION OF THE FIGURES

Other features and advantages of the present invention will become clear upon reading the following description, given solely by way of non-limiting example, and given with reference to the attached drawings in which:

FIGS. 2A, 2B and 2C are schematic views of the fractions-of-a-second indicator of a display device according to a first particular embodiment of the invention, the three figures respectively showing the fractions-of-a-second indicator following resetting, following starting and following stopping of the chronograph;

DETAILED DESCRIPTION OF EMBODIMENTS

Figure 1:
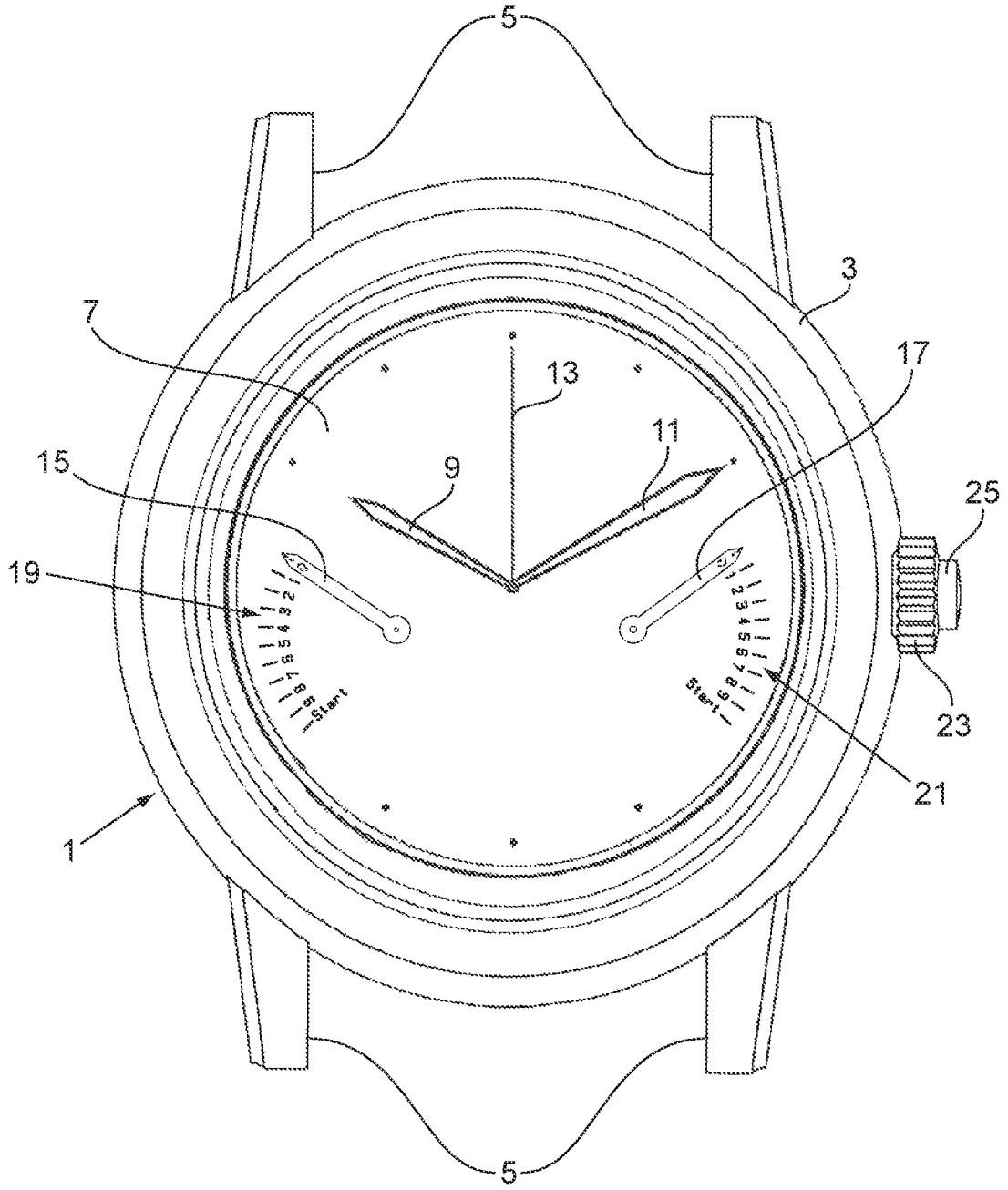
FIG. 1 is a plan view of the dial side of a chronograph watch fitted with a display device in accordance with one particular embodiment of the invention.

Three exemplified embodiments of the invention are explained in the following description. These three embodiments are intended to be integrated into chronograph mechanisms. However, it will be understood that the display device of the invention can also be fitted in other types of timepieces. These include in particular countdown timepieces and timepieces having a regatta mode. FIG. 1 is a plan view of the dial side of a chronograph watch fitted with a display device in accordance with one particular embodiment of the invention. The chronograph watch 1 firstly comprises a watch case 3 provided with two pairs of horns 5 which are intended to serve as attachments for each of the two straps of a bracelet (not shown). It is possible to see that the case also has a time-setting and winding mechanism crown 23 as well as a push button 25 which are both arranged at 3 o'clock on the middle. In a known manner, the push button 25 is arranged concentrically with the crown 23. It is possible to cause the starting, stopping and resetting of the chronograph by actuating the push button 25. FIG. 1 also shows a dial 7, two hands for the hours 9 and minutes 11 provided to indicate the current time and arranged to turn about a spindle at the centre of the dial, a chronograph-hand 13 also mounted at the centre of the dial, and two fractions-of-a-second indicators each comprising a retrograde hand mounted on an eccentric spindle. The first retrograde hand 15 is arranged to pivot about a spindle which stands proud of the dial at around the 7:30 position and the second retrograde hand 17 is arranged to pivot about a spindle which stands proud of the dial at around the 4:30 position. According to the embodiment of the present example, the display device of the invention comprises two indicating members formed by retrograde hands. However, it will be understood that the indicating members are not necessarily produced in the form of hands. They could be e.g. discs or fluids, etc.

The first retrograde hand 15 is provided to cooperate with a first scale 19 in the form of an arc of a circle to indicate the tenths of a second within the fractional part of the time interval measured by the chronograph, and the second retrograde hand 17 is provided to cooperate with a second scale 21 in the form of an arc of a circle to indicate the hundredths of a second within the remainder of the fractional part. It is possible to see that the scale 19, unlike the scale 21, increases in the anti-clockwise direction. According to the embodiment covered by the present example, the two scales 19 and 21 in the form of an arc of a circle each comprise ten gaps of equal width separated from each other by nine markings numbered 1 to 9. Furthermore, each scale 19, 21 also comprises an end marking at each of its ends. The end marking which is placed at the start of a scale (before the "1") is associated with the "0" or "resetting" indication, whereas the end marking which is placed at the end of a scale (after the "9") is associated with the "start" indication.

The chronograph going train (not shown) of the chronograph watch illustrated in FIG. 1 is distinct from the going trains of most of the known chronograph mechanisms in that it is arranged to drive a tenths-of-a-second counter and a hundredths-of-a-second counter. For this purpose, the seconds disc of the chronograph going train (not shown) is arranged to mesh with the pinion of a first intermediate wheel, and the disc of this intermediate wheel is arranged to mesh with the pinion of a tenths-of-a-second counting wheel. Furthermore, the disc of the tenths-of-a-second counting wheel is arranged to mesh with the pinion of a second intermediate wheel, and the disc of this second intermediate wheel is arranged to mesh with the pinion of a hundredths-of-a-second counting wheel. The gear ratios of the part of the chronograph going train just described are selected so that, when the chronograph seconds disc turns at the rate of one turn per minute, the tenths-of-a-second counting wheel turns at the rate of one turn per second, and the hundredths-of-a-second counting wheel turns at the rate of ten turns per second. By way of example, the teeth of the chronograph seconds disc may comprise 80 teeth, the pinion and the disc of the first intermediate wheel can comprise 10 and 75 teeth respectively, the pinion and the disc of the tenths-of-a-second counting wheel can comprise 10 and 60 teeth respectively, the pinion and the disc of the second intermediate wheel can comprise 20 and 40 teeth respectively, and finally, the pinion of the hundredths-of-a-second counter can comprise 12 teeth. It is worth also stating that if the snails were chosen with a larger number of steps, it would be possible to drive the counting wheels at lower rates. For example, by splitting the snail of the hundredths-of-a-second counter so that it has two series of 10 steps arranged symmetrically, it would be possible to drive the hundredths-of-a-second counter at the speed of five turns per second instead of ten.

Figure 2A:
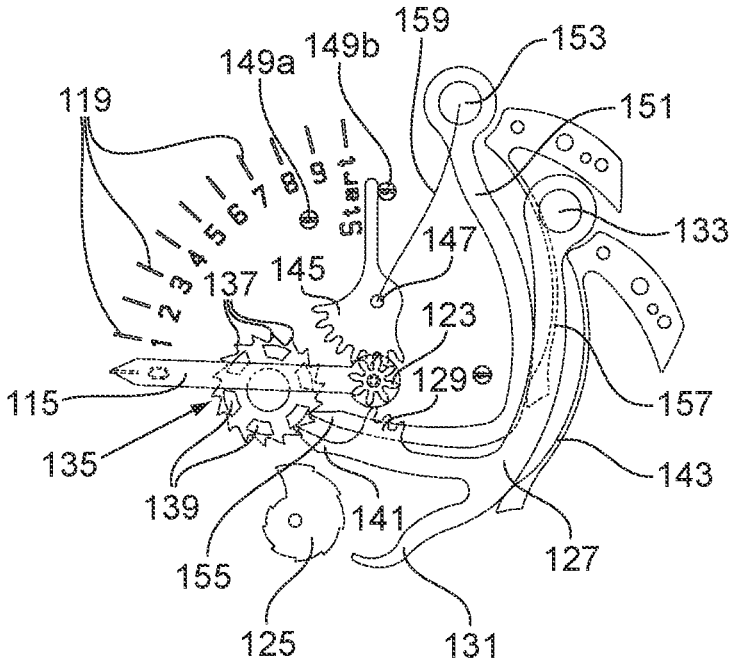
Figure 2B:
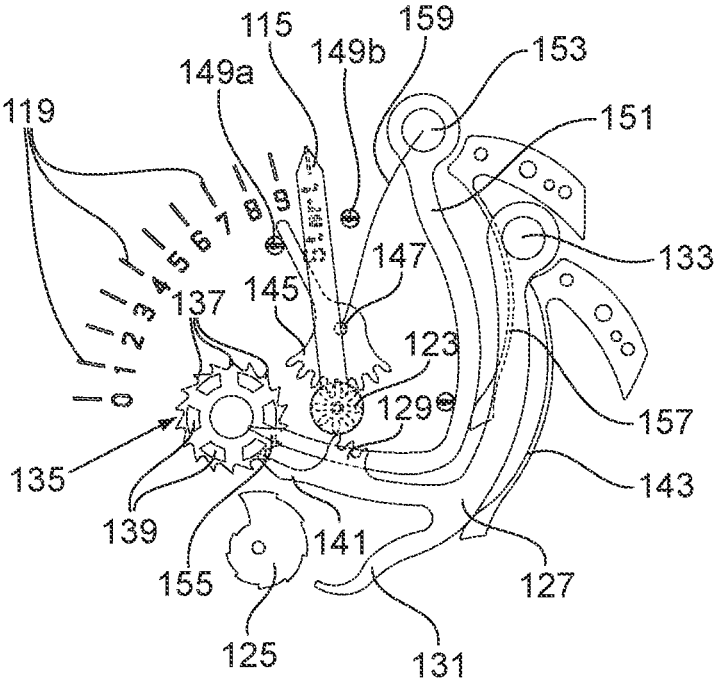

FIGS. 2A, 2B and 2C are schematic views of the fractions-of-a-second indicator of a display device according to a first particular embodiment of the invention. These three figures respectively show the fractions-of-a-second indicator in its configuration following resetting, following starting and following stopping of the chronograph. Each of the figures shows a pinion 123, a retrograde hand 115 rigidly mounted on the spindle of the pinion, a series of markings arranged along an arc of a circle so as to form a scale 119, a snail 125 mounted on the spindle of a fractions-of-a-second counting wheel (not shown) so as turn as one piece therewith, a rack 127 provided with a toothed sector 129, and a feeler spindle 131 rigidly mounted on the rack.

The above-mentioned figures also show a column wheel 135 comprising a ratchet wheel provided with eighteen teeth 137, and six columns 139 standing on the plate of the ratchet wheel. As will be shown in more detail below, the column wheel 135 is provided in particular to permit control of the fractions-of-a-second indicator of the display device. A person skilled in the art, however, will understand that the column wheel 135 is also part of the manual control mechanism arranged to permit cyclical starting, stopping and resetting of the whole chronograph. In a conventional manner, in the present example, the manual control mechanism of the chronograph also comprises a push button (referenced 25 in FIG. 1) which is arranged to permit the column wheel to be incremented in a step-by-step manner. Each time the column wheel 135 is incremented by one step, it turns by the angular value of one ratchet tooth (i.e. by 20°) clockwise (as shown in the figures).

It will be noted that FIGS. 2A, 2B and 2C illustrate the column wheel in three different angular positions. In fact, if the column wheel 135 is in the configuration shown in FIG. 2A and it is incremented by one step it pivots clockwise by the angular value of one ratchet tooth. The column wheel thus comes to a halt in the configuration shown in FIG. 2B. If it is now incremented by one more step, it pivots again to come to a halt this time in the configuration shown in FIG. 2C. Finally, if it is incremented a third time, it pivots again by the angular value of one ratchet tooth to be back in the configuration shown in FIG. 2A. It will thus be understood that the column wheel 135 returns to its starting configuration when it is incremented by three steps. In other words, the column wheel 135 is a three-time column wheel. However, it will be noted that, according to other embodiments of the invention, the column wheel could be a two-time column wheel.

Returning now to the fractions-of-a-second indicator, it is possible to see that the rack 127 is mounted to pivot about a spindle 133 and that it is provided with a beak 141 which is urged in the direction of the columns of the column wheel 135 by a spring 143. As shown in FIG. 2A, following resetting of the chronograph, the beak 141 bears against a column of the column wheel so that it cannot be lowered. In this situation, the rack is in a waiting position in which the feeler spindle 131 is kept away from the snail 125 and the toothed sector 129 is kept disconnected from the pinion 123. If the column wheel is now incremented by one step in order to cause starting of the chronograph, the column wheel pivots by 20° so that the beak 141 of the rack 127 is forced to slide against the outer face of the column 139. Referring now to FIG. 2B, it is possible to see that although the beak 141 has slid against the column 139 by the angular value of one ratchet tooth it still bears against this column. The rack 127 is thus still in the waiting position in spite of the starting of the chronograph. If the column wheel is now incremented again by one additional step in order to cause the stopping of the chronograph, the column wheel again pivots by 20° so that this time the beak 141 falls into the space between two columns. The rack 127 is thus free to pivot clockwise. With reference now to FIG. 2C it can be seen that, following stopping of the chronograph, the rack 127 is in its reading position in which the feeler spindle 131 bears against the periphery of the snail 125, while the toothed sector 129 meshes with the pinion 123. It will be understood that when the rack 127 is in the reading position, the angular position of the retrograde hand 115 is determined by that of the snail 125. If the column wheel is now incremented by one more step in order to cause resetting of the chronograph, the column wheel 135 again pivots by 20° so that the beak 141 is raised by a new column 139 of the column wheel, which causes pivoting of the rack 127 in the anti-clockwise direction. The fractions-of-a-second indicator thus returns to the configuration illustrated in FIG. 2A.

In accordance with the invention, the fractions-of-a-second indicator of the display device also comprises means for moving the retrograde hand into a first predefined position when the chronograph is being reset, and to move the retrograde hand into a second predefined position, different from the first position, when the chronograph is being started. In relation to this and with reference again to FIGS. 2A, 2B and 2C, it is possible to see a rack 145 which is arranged to pivot about its spindle 147 and to mesh permanently with the pinion 123, two stops 149*a* and 149*b* defining a sector within which the rack 145 is free to pivot, a control lever 151 arranged to pivot about its spindle 153 and having a beak 155, a spring 157 arranged to urge the beak 155 in the direction of the columns 139 of the column wheel 135, and a spring-leaf 159 rigidly fixed by one of its ends to the pivot spindle 153 of the control lever 151 and by its other end to the pivot spindle 147 of the rack 145.

According to the first exemplified embodiment of the invention, the distance between the pivot spindle 153 of the control lever and the pivot spindle 147 of the rack is less than the undeformed length of the spring-leaf 159. In this situation, in a manner known per se, the spring-leaf is subject to stresses which prevent it from adopting an undeformed configuration (or in other words: straight). In order to minimise stresses and to recover a stable configuration, the spring-leaf 159 adopts a buckled shape (or in other words, curved by deformation in a direction perpendicular to the plane containing the two pivot spindles 153 and 147). The expression "stable configuration" is understood to mean a configuration associated with a shape to which the spring-leaf always returns if it is moved away therefrom by a force of sufficiently low amplitude. The round shape owing to the buckling of the spring-leaf 159 can be orientated in one direction or the other. It will be understood that the spring-leaf 159 can thus occupy one or other of the two stable configurations which are symmetrical.

As already mentioned, one of the ends of the spring-leaf 159 is rigidly fixed to the pivot spindle 153 of the control lever 151, while its other end is fixed in the same way to the pivot spindle 147 of the rack 145. Referring again to FIGS. 2A, 2B and 2C, it can be understood that when the round shape of the spring-leaf 159 is orientated in a first direction (towards the right in the figures), the spring-leaf urges the rack 145 clockwise and urges the control lever 151 anti-clockwise (as illustrated in FIGS. 2A and 2C). Conversely, when the round shape of the spring-leaf 159 is orientated in the other direction (towards the left in the figures), the spring-leaf urges the rack 145 anti-clockwise and urges the control lever 151 clockwise (as illustrated in FIG. 2B). A person skilled in the art will understand that the system formed by the spring-leaf 159, the rack 145 and the control lever 151 is a bistable system, one of the two stable configurations of the system being shown in FIGS. 2A and 2C, and the other stable configuration of the system being shown in FIG. 2B. In this situation, when the system is in one of its two stable configurations and the control lever 151 is forced to pivot, the bistable system as a whole is forced to switch and to change to the other configuration.

The means for moving the retrograde hand into a first predefined position when the chronograph is being reset, and to move the retrograde hand into a second predefined position, different from the first position, when the chronograph is being started, operate in the following manner. The control lever 151 is arranged to be controlled by the column wheel 135 so as to pivot in one direction or the other between a first position in which the beak 155 is raised by one of the columns 139 and a second position in which the beak 155 is lowered into the space between two columns. With reference firstly to FIG. 2A, it is possible to see that, following resetting of the chronograph, the control lever 151 is in its first position. In this situation, the bistable system formed by the control lever, the spring-leaf 159 and the rack 145 occupies a first of its two stable configurations. As shown in FIG. 2A, in this first configuration, the rack is fully turned in the clockwise direction so that it bears against the stop 149*b*. Furthermore, as the toothed sector of the rack 145 meshes with the pinion 123, the retrograde hand 115 is, for its part, fully turned in the anti-clockwise direction so that it is located opposite the end marking associated with the "zero" indication of the scale 119.

If the column wheel is now incremented by one step in order to cause starting of the chronograph, the column wheel pivots by 20° so that the beak 155 of the control lever falls into the space between two columns 139, the control lever 151 thus changing to its second position. Referring now to FIG. 2B, it can be seen that the bistable system formed by the control lever, the spring-leaf 159 and the rack 145 has changed from one to the other of these two stable configurations. In this new configuration, the rack is fully turned in the anti-clockwise direction so that it bears against the stop 149*a*. The retrograde hand 115 is, for its part, fully turned in the clockwise direction so that it is located opposite the end marking associated with the "start" indication of the scale 119. If the column wheel is now incremented again by one additional step in order to cause stopping of the chronograph, the column wheel again pivots by 20° so that the beak 155 is again raised by one of the columns 139, and the control lever 151 resumes its first position. Referring now to FIG. 2C, it is possible to see that, following stopping of the chronograph, the bistable system formed by the control lever, the spring-leaf 159 and the rack 145, has not resumed its first stable configuration but is, in contrast, in an intermediate position which is unstable. In fact, as has been seen, following stopping of the chronograph, the toothed sector 129 of the rack 127 meshes with the pinion 123 so that the angular position of the retrograde hand 115 is determined by that of the snail 125. In fact, the force of the spring-leaf 159 is selected to be lower than that of the return spring 143. In this situation, following stopping of the chronograph, it is the pinion 123 which controls the position of the rack 145 and not the reverse.

Figure 3:
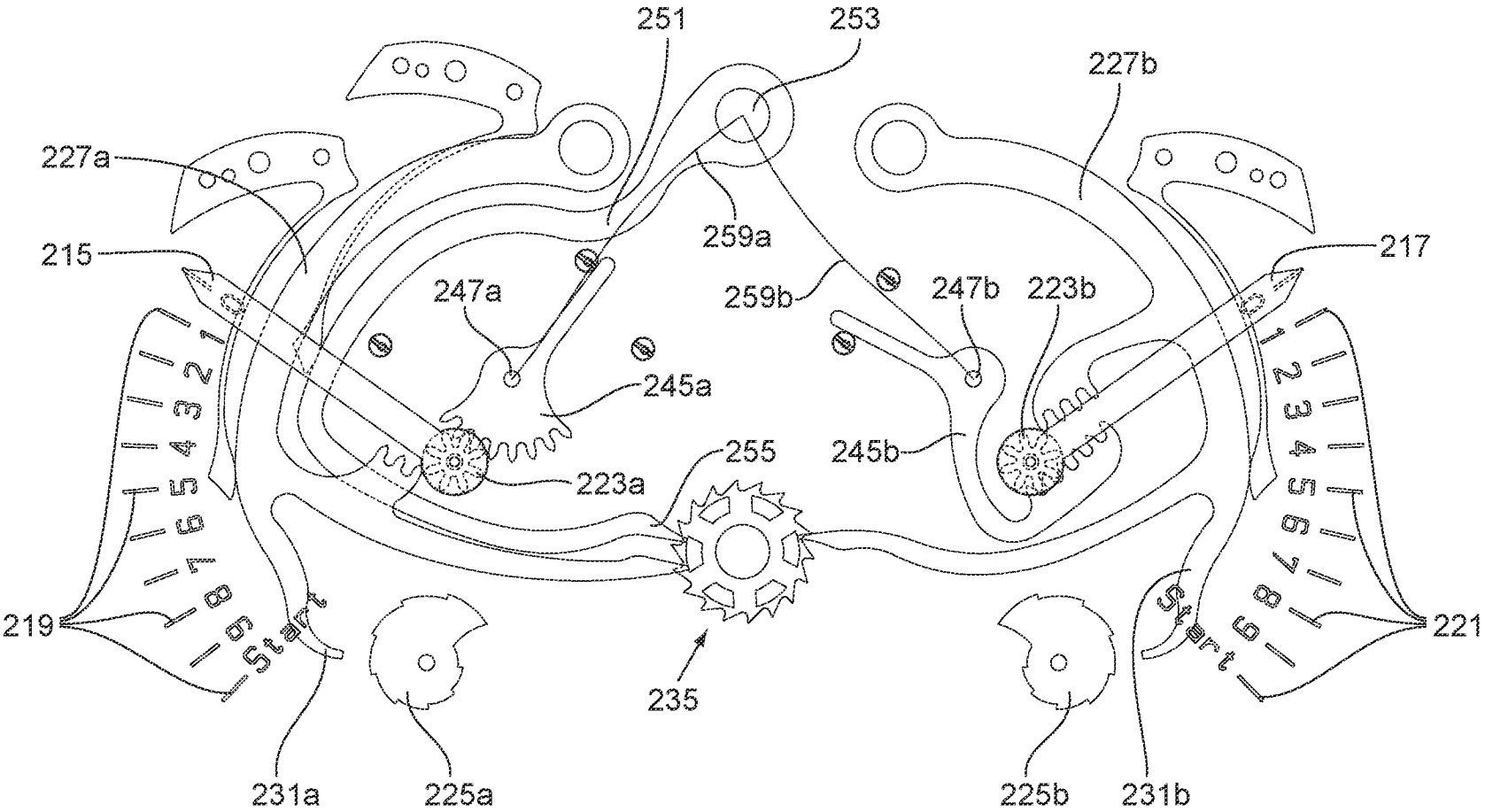
FIG. 3 is a partial schematic view of a display device according to a variant of the first embodiment illustrated in FIGS. 2A, 2B and 2C, the variant of the display device comprising two snails arranged to control two retrograde hands in order to indicate respectively first and second fractions of a second, and the display device being shown following resetting of the chronograph.

FIG. 3 is a partial schematic view of a display device according to a variation of the embodiment just described, and which has two fractions-of-a-second indicators. The operating principal of each of these two indicators is very similar to that of the fractions-of-a-second indicator already described in relation to FIGS. 2A, 2B and 2C. The following description is thus limited essentially to explaining how the two fractions-of-a-second indicator are associated.

As it is possible to see, the fractions-of-a-second indicators of FIG. 3 each comprise a snail (respectively referenced 225*a* and 225*b*). The two snails are arranged to control two retrograde hands 215 and 217 in order to indicate the fractional part of a time interval measured by the chronograph. The snail 225*a* is mounted on the spindle of the tenths-of-a-second counting wheel (not shown) so that it turns at the rate of one turn per second, and the snail 225*b* is mounted on the spindle of the hundredths-of-a-second counting wheel (not shown) so that it turns at a rate of ten turns per second. The hands 215 and 217 thus indicate tenths and hundredths of a second respectively. FIG. 3 also shows two pinions 223*a*, 223*b*, on the spindles of which are mounted the retrograde hands, two scales 219, 221 in the form of an arc of a circle, which are each formed by a series of markings, two racks 227*a*, 227*b* each provided with a toothed sector and a feeler spindle 231*a*, 231*b*, two racks 245*a*, 245*b* arranged to pivot about their respective spindle 247*a* or 247*b* and each to mesh permanently with one of the two pinions 223*a*, 223*b*, a single control lever 251 which has a beak 225 and which is arranged to pivot about its spindle 253, and two spring-leaves 259*a* and 259*b* fixed rigidly by one of their ends to the pivot spindle 253 of the control lever 251 and by the other end, respectively, to the pivot spindles 247*a* and 247*b* of the two racks 245*a* and 245*b*. FIG. 3 also shows that the two spring-leaves 259*a*, 259*b* are not arranged as an extension of each other but that, in contrast, they form an angle of about 90° with each other. In fact, according to one embodiment which is the object of this example, it is possible to make a free choice of the value of the angle between the ends of the two spring-leaves which must be rigidly fixed to the pivot spindle 253.

A person skilled in the art will understand that the system formed by the control lever 251, the two spring-leaves 259*a*, 259*b*, and the two racks 245*a*, 245*b* is a bistable system. FIG. 3 shows that the display device, following resetting of the chronograph, presents one of the two stable configurations of the bistable system. In this configuration, the racks 245*a*, 245*b* are fully turned anti-clockwise, and the retrograde hands 215, 217 are both opposite the end marking associated with the "zero" indication of one of the scales 219, 221. If the column wheel 235 is now incremented by one step in order to cause starting of the chronograph, the beak 255 of the control lever 251 falls into the space between two columns of the column wheel so that the control lever 251 pivots anti-clockwise. This pivoting causes the switching of the bistable system as a whole, which thus changes from one of these two stable configurations to the other. A person skilled in the art will understand that when the bistable system is in this second stable configuration, the retrograde hands 215, 217 are each opposite the end marking associated with the "start" indication of one of the scales 219 and 221.

Figure 4A:
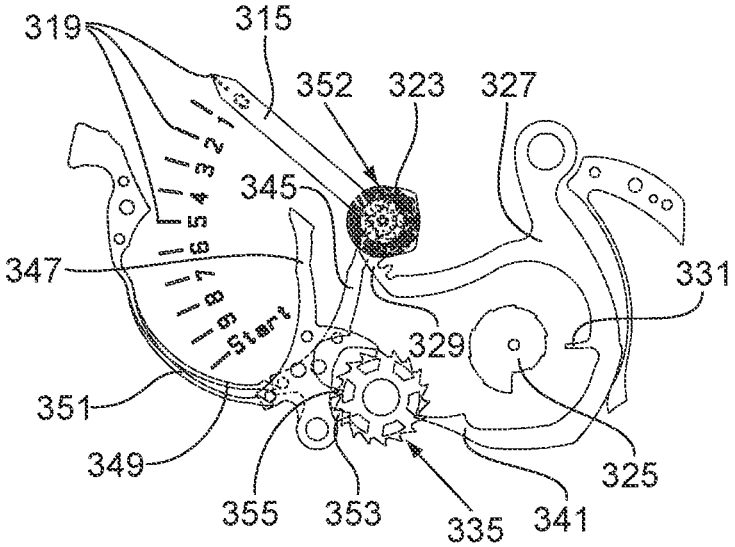
FIGS. 4A, 4B and 4C are schematic views of the fractions-of-a-second indicator of a display device according to a second particular embodiment of the invention, the three figures respectively showing the device following resetting, following starting and following stopping of the chronograph.
Figure 4B:
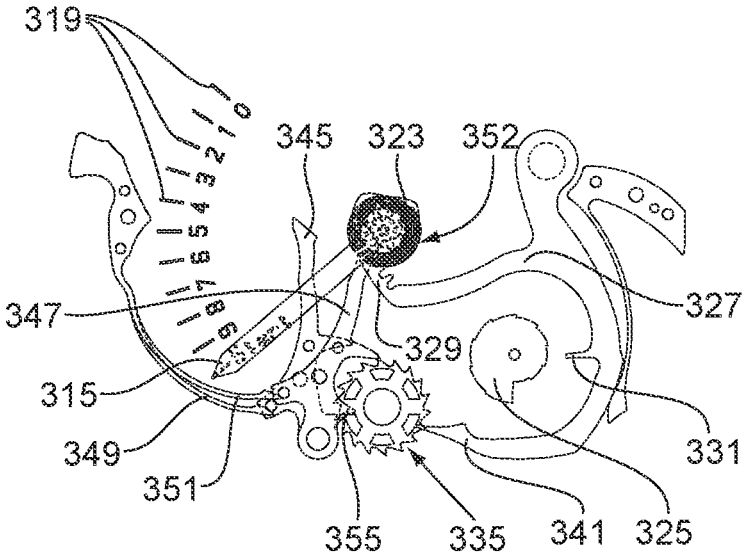
Figure 4C:
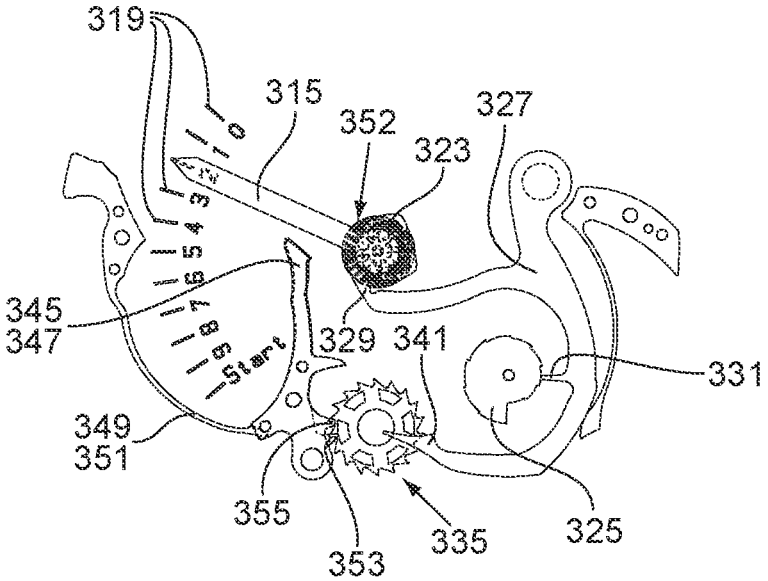

FIGS. 4A, 4B and 4C are schematic views of the fractions-of-a-second indicator of a display device according to a second particular embodiment of the invention. These three figures respectively show the indicator following resetting, following starting and following stopping of the chronograph. The fractions-of-a-second indicator illustrated by FIGS. 4A, 4B and 4C has many features in common with the fractions-of-a-second indicator of FIGS. 2A, 2B and 2C. The elements of FIGS. 4A, 4B and 4C which are identical or similar to elements which have already been described in relation to FIGS. 2A, 2B and 2C are referenced by the same numerals increased by two hundred.

FIGS. 4A, 4B and 4C show in particular a pinion 323, a retrograde hand 315 rigidly mounted on the spindle of the pinion, a series of markings arranged along an arc of a circle so as to form a scale 319, a snail 325 mounted on the spindle of a fractions-of-a-second counting wheel (not shown), a rack 327 provided with a toothed sector 329, a feeler spindle 331 rigidly mounted on the rack, and a column wheel 335. It is also possible to see that the rack 327 is provided with a beak 341 which is urged in the direction of the column wheel 335. As shown in FIGS. 4A and 4B, following resetting and following starting of the chronograph, the beak 341 bears against a column of the column wheel so that it cannot be lowered. FIGS. 4A and 4B thus show the rack 327 in its waiting position in which the feeler spindle 331 is kept away from the snail 325 and the toothed sector 329 is kept disconnected from the pinion 323. With reference now to FIG. 4C it can be seen that, following stopping of the chronograph, the rack 327 is in its reading position in which the feeler spindle 331 bears against the periphery of the snail 325, while the toothed sector 329 meshes with the pinion 323.

The second embodiment essentially differs from the first in that the means it comprises to move the retrograde hand into a first predefined position when the chronograph is being reset, and to move the retrograde hand into a second predefined position, different from the first position, when the chronograph is being started, operate in a different manner. The following description thus concentrates on these means. In this regard, FIGS. 4A, 4B and 4C show a first and a second hammer (respectively referenced 345 and 347) which are respectively urged in the direction of two coaxial heart pieces (not shown) by two springs 349 and 351. The heart pieces are both rigidly fixed on the spindle of the pinion 323. It is also possible to see that the hammers 345 and 347 each have a beak (respectively referenced 353 and 355) which is arranged to cooperate with the columns of the column wheel 335.

With reference now to FIG. 4A, it is possible to see that following resetting of the chronograph, the beak 353 of the hammer 345 has fallen between two columns of the column wheel, causing the hammer 345 to be lowered against the heart piece with which it is associated. The cooperation of the hammer 345 and the heart piece causes the retrograde hand 315 to move opposite the end marking associated with the "zero" indication of the scale 319. Referring now to FIG. 4B, it is possible to see that following the starting of the chronograph, the beak 353 has been raised by one of the columns of the column wheel, and that the hammer 345 is no longer in contact with the heart piece with which it is associated. On the other hand, it is now the beak 355 of the hammer 347 which has fallen between two columns so that the hammer 347 is lowered against the heart piece with which it is associated. The cooperation of the hammer 347 and the heart piece causes the retrograde hand 315 to move opposite the end marking associated with the "start" indication of the scale 319. Finally, with reference to FIG. 4C it is possible to see that following stopping of the chronograph, the two hammers 345 and 347 are raised so that the angular position of the retrograde hand 315 is determined by that of the snail 325.

FIGS. 4A, 4B and 4C also show a spring-leaf 352 which is wound about the spindle of the pinion 323 and which is fixed by one end to the plate and by the other end to the spindle of the pinion 323 which supports the retrograde hand 315, so as to urge the retrograde hand 315 anti-clockwise. The presence of the spring-leaf 352 permits the play existing between the teeth of the toothed sector 329 and those of the pinion 323 to be cancelled out.

Figure 5A:
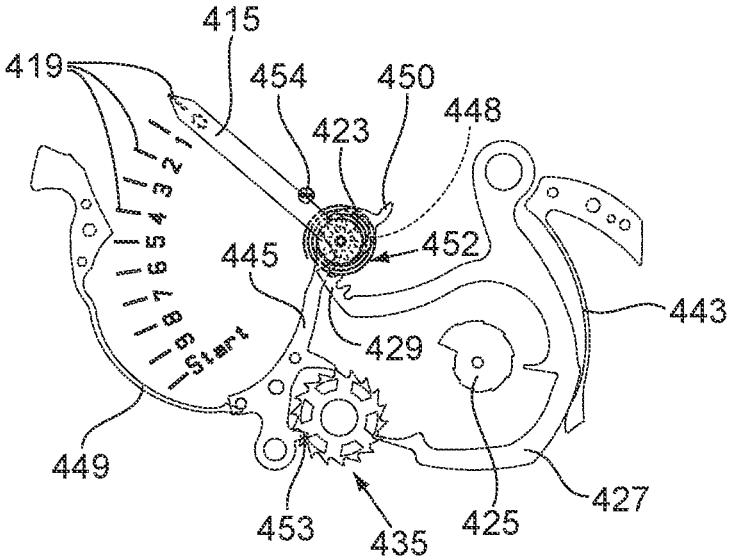
FIGS. 5A, 5B and 5C are schematic views of the fractions-of-a-second indicator of a display device according to a third particular embodiment of the invention, the three figures respectively showing the device following resetting, following starting and following stopping of the chronograph.
Figure 5B:
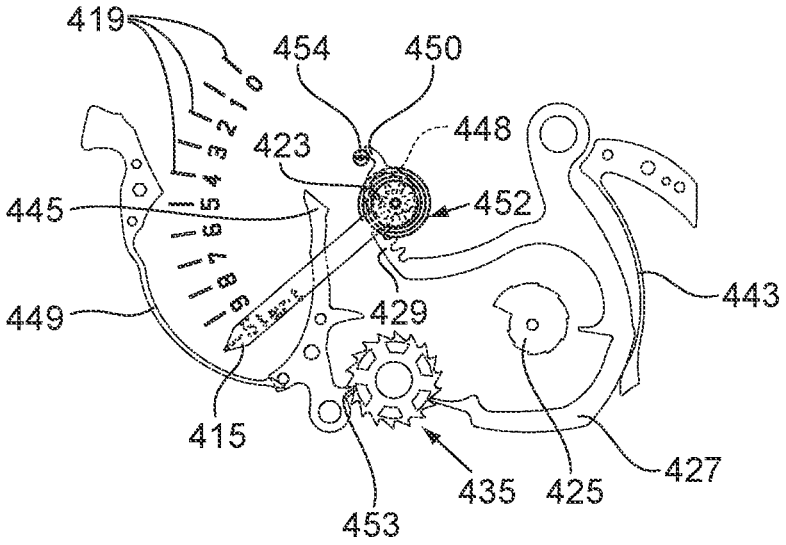
Figure 5C:
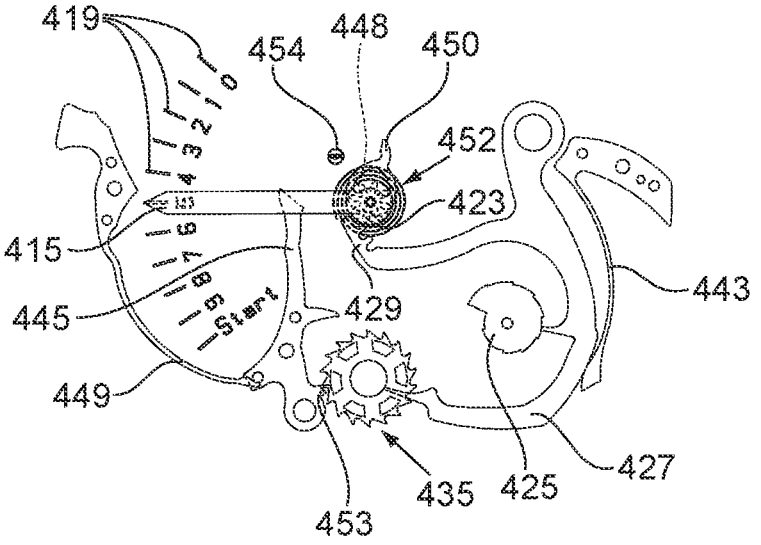

FIGS. 5A, 5B and 5C relate to the fractions-of-a-second indicator of a display device according to a third particular embodiment of the invention. The fractions-of-a-second indicator illustrated in these figures has many features in common with the fractions-of-a-second indicator of FIGS. 4A, 4B and 4C. The elements of FIGS. 5A, 5B and 5C which are identical or similar to elements which have already been described in relation to FIGS. 4A, 4B and 4C are referenced by the same numerals increased by one hundred.

The third embodiment essentially differs from the first and second by the means it comprises to move the retrograde hand into a first predefined position when the chronograph is being reset, and to move the retrograde hand into a second predefined position, different from the first position, when the chronograph is being started. The following description thus concentrates on these means. In this regard, FIGS. 5A, 5B and 5C show a single hammer (referenced 445) which is urged by a spring 449 in the direction of a one-piece cam formed by a heart piece 448 and a finger 450 (FIG. 5D and also visible in phantom in FIGS. 5A, 5B and 5C). The single-piece cam is itself rigidly fixed to the spindle of the pinion 423. It is also possible to see that the hammer 445 has a beak 453 arranged to cooperate with the columns of the column wheel 435.

Figure 5D:
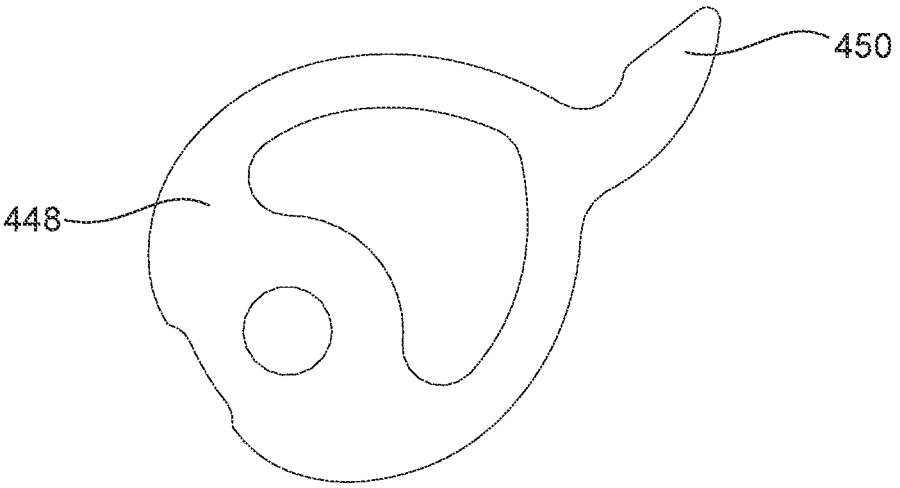
FIG. 5D is a schematic plan view showing the heart-piece and the finger of the fractions-of-a-second indicator of FIGS. 5A, 5B and 5C.

With reference in particular to FIG. 5D it is possible to see that the single-piece cam is formed by the heart piece 448 and the finger 450. In the present example, the finger 450 is arranged in the position usually occupied by the point of the heart piece. FIGS. 5A, 5B and 5C also show a stop 454 arranged to be able to cooperate with the finger 450, a spring-leaf 452 which is wound about the spindle of the pinion 423 and which is fixed by one end to the plate and by the other end to the retrograde hand 415, so as to urge the retrograde hand 415 and the finger 450 anti-clockwise. As FIG. 5B shows, the stop 454 is arranged so that the finger meets the stop when the hand 415 is located above the "start" indication. In one advantageous variation, the stop 454 can be produced in the form of an eccentric in order to permit finer regulation of the second predefined position.

With reference now to FIG. 5A in particular, it is possible to see that following resetting of the chronograph, the beak 453 of the hammer 445 has fallen between two columns of the column wheel, causing the hammer 445 to be lowered against the heart piece. The cooperation of the hammer 445 and the heart piece causes the retrograde hand 415 to move opposite the end marking associated with the "zero" indication of the scale 419. Referring now to FIG. 5B, it is possible to see that following the starting of the chronograph, the beak 453 has been raised by one of the columns of the column wheel, and that the hammer 445 is no longer in contact with the heart piece. In this situation, the retrograde hand 415 is free to turn anti-clockwise under the effect of the spring-leaf 452. The pivoting of the retrograde hand 415 anti-clockwise moves this hand opposite the end marking associated with the "start" indication of the scale 419. Finally, with reference to FIG. 5C it is possible to see that following stopping of the chronograph, the angular position of the retrograde hand 415 is determined by that of the snail 425. In fact, the return spring 443 is selected to be stronger than the spring-leaf 452.

It will also be understood that various modifications and/or improvements obvious to a person skilled in the art can be made to the embodiments being described in the present description without departing from the scope of the present invention defined by the accompanying claims. As already indicated, the display device of the invention is not exclusively reserved for chronographs. It can also be fitted to other types of timepiece, such as e.g. countdown mechanisms or regatta watches. It should be remembered that regatta watches are fitted with a countdown facility which makes it possible to display the last minutes preceding the start of the competition.

The invention claimed is:

1. A display device for a timepiece including a counting wheel and a manual control mechanism configured to permit cyclical starting, stopping and resetting of the counting wheel, the display device comprising:

an indicating member; and a movement system configured to:

allow the indicating member to be moved into a reading position following stopping of the counting wheel, the reading position being determined by a position of the counting wheel and move the indicating member to a first predefined position when the counting wheel is being reset, and to a second predefined position, different from the first predefined position, when the counting wheel is being started.

2. The display device as claimed in claim 1, wherein the movement system is configured to move the indicating member into the reading position automatically when the counting wheel is being stopped.

3. The display device as claimed in claim 1, wherein the indicating member is a retrograde indicating member.

4. The display device as claimed in claim 1, wherein the movement system comprises a snail and a feeler spindle configured to cooperate with the periphery of the snail.

5. The display device as claimed in claim 4, wherein the movement system comprises a pinion kinematically connected to the indicating member to permit driving thereof.

6. The display device as claimed in claim 5, wherein the indicating member is mounted on a spindle of the pinion.

7. The display device as claimed in claim 6, wherein the movement system comprises a rack, the feeler spindle being fixedly attached to the rack, a toothed sector of the rack being configured to mesh with the pinion, the rack being configured to move between a reading position, in which the feeler spindle bears against the periphery of the snail so that the angular position of the indicating member is determined by the angular position of the snail, and a waiting position, in which the feeler spindle is kept away from the snail while the rack is kept disconnected from the pinion.

8. The display device as claimed in claim 7, wherein the manual control mechanism of the timepiece comprises a push button and a column wheel, and wherein the rack is provided with a beak which is urged against the column wheel.

9. The display device as claimed in claim 8, further comprising:

a first heart piece mounted on the spindle of the pinion; and a first hammer urged against the heart piece, the first hammer having a beak configured to cooperate with the column wheel to fall into the space between two columns when the counting wheel is being reset, and to be raised by one of the columns when the counting wheel is being started, the first hammer being shaped to be lowered against the first heart piece when the beak falls into the space between two columns and to be raised when the beak is raised by a column.

10. The display device as claimed in claim 9, further comprising a second hammer configured to be lowered against a second heart piece when the counting wheel is being started and to be raised when the counting wheel is being stopped.

11. The display device as claimed in claim 7, further comprising a control lever, a spring leaf and a rack which together form a bistable system, and wherein the rack is configured to mesh with the pinion so as to move the indicating member into the first predefined position when the bistable system switches to a first stable position of two stable positions, and to move the indicating member into the second predefined position when the bistable system switches from the first stable position to a second stable position of the two stable positions.

12. The display device as claimed in claim 11, wherein the timepiece is a chronograph and the counting wheel is a chronograph counting wheel.

13. The display device as claimed in claim 12, wherein the chronograph counting wheel is a fractions-of-a-second counting wheel.

14. The display device as claimed in claim 13, wherein said fractions-of-a-second counting wheel is a counting wheel for first fractions of a second, and wherein the display device further comprises a counting wheel for second fractions of a second, the first fraction of a second being equal to a multiple of the second fraction of a second.

15. The display device as claimed in claim 14, further comprising two spring-leaves forming an angle with one another, the angle being in the range between 30° and 150°.

16. A timepiece fitted with a counting wheel and a manual control mechanism which is arranged to permit cyclical starting, stopping and resetting of the counting wheel, the timepiece comprising:

the display device as claimed in claim 1.

17. The display device as claimed claim 1, wherein the timepiece has a countdown or regatta mode, and wherein the counting wheel is a countdown counting wheel.

18. A timepiece fitted with a counting wheel and a manual control mechanism which is arranged to permit cyclical starting, stopping and resetting of the counting wheel, the timepiece comprising:

the display device as claimed in claim 17.

19. The display device of claim 15, wherein the angle between the two spring-leaves is equal to about 90°.

* * * * *